US005248208A

United States Patent [19]

Yoshida et al.

[11] Patent Number: 5,248,208

[45] Date of Patent: Sep. 28, 1993

[54] METHOD FOR SETTING INK RIBBON INTO CASSETTE BODY AND INK RIBBON CASSETTE TO WHICH SUCH METHOD IS APPLICABLE

[75] Inventors: Norihiro Yoshida; Yukio Saito; Tomoyuki Nagamine, all of Inagi, Japan

[73] Assignee: Fujitsu Isotec Limited, Tokyo, Japan

[21] Appl. No.: 17,260

[22] Filed: Feb. 12, 1993

[30] Foreign Application Priority Data

Feb. 18, 1992 [JP] Japan ..... 4-030563

[51] Int. Cl.[5] ..... B41J 35/28

[52] U.S. Cl. ..... 400/208.1; 242/197

[58] Field of Search ..... 400/196, 194, 208, 208.1; 242/197, 198, 199

[56] References Cited

U.S. PATENT DOCUMENTS

| | | | |
|---|---|---|---|
| 3,151,724 | 10/1964 | Ross et al. | 400/208.1 |
| 3,581,864 | 6/1971 | Landgraf | 400/208.1 |
| 4,134,693 | 1/1979 | Crickmore et al. | 400/208 |
| 4,974,977 | 12/1990 | Morgan et al. | 400/208 |
| 5,160,206 | 11/1992 | Haftmann et al. | 400/208 |

FOREIGN PATENT DOCUMENTS

| | | |
|---|---|---|
| 2-48981 | 2/1990 | Japan . |
| 3-83682 | 4/1991 | Japan . |

*Primary Examiner*—Eugene H. Eickholt

*Attorney, Agent, or Firm*—Armstrong, Westerman, Hattori, McLeland & Naughton

[57] ABSTRACT

An assembly is formed of a first core and a second core on which cores an ink ribbon is wound and a supporting member detachably supporting the first and second cores so as to keep them a predetermined distance. The assembly is set into a setting hole formed on a bottom plate of a cassette body, the setting hole being divided into a first hole part for rotatably supporting the first core, a second hole part for rotatably supporting the second core, and a third hole part connecting the first and second hole parts which are a predetermined distance from each other, the distance between the first and second cores supported by the supporting member corresponding to the distance between the first and second hole parts. The supporting member is detachable from the first and second cores and drawn from the cassette body through the setting hole, so that the first and second cores respectively remain in the cassette body in a state where the first and second cores are respectively set into the first and second hole parts formed on the bottom plate of the cassette body.

13 Claims, 3 Drawing Sheets

METHOD FOR SETTING INK RIBBON INTO CASSETTE BODY AND INK RIBBON CASSETTE TO WHICH SUCH METHOD IS APPLICABLE

BACKGROUND OF THE INVENTION (1) Field of the invention

The present invention generally relates to a method for setting an ink ribbon into a cassette body and an ink ribbon cassette to which the method is applicable, and more particularly to a method for enabling to easily set an ink ribbon into a cassette body, and to an ink ribbon cassette in which an ink ribbon can be easily replaced.

(2) Description of the related art

When an ink ribbon in an ink ribbon cassette has been completely used up in a printer, the ink ribbon must be replaced. In this case, if the whole ink ribbon cassette including the ink ribbon is changed to new one, a running cost of the printer increases and resources are wasted. Thus, an ink ribbon cassette has been proposed in which only an ink ribbon can be replaced.

In a conventional ink ribbon cassette, an ink ribbon is wound to a supply ribbon core and an end of the ink ribbon is fixed on a take-up ribbon core. Both the supply ribbon core and the take-up ribbon core are rotatably mounted in a cassette body. While a printing operation is being performed, the supply ribbon core and the take-up ribbon core are rotated in a predetermined direction so that the ink ribbon moves from the supply ribbon core to the take-up ribbon core. The ink ribbon is thus wound to the take-up ribbon core.

When the ink ribbon is replaced, the supply ribbon core and the take-up ribbon core to which a used ink ribbon has been wound are removed from the cassette body, and a new supply ribbon core, having a new ink ribbon wound thereon, and a new take-up ribbon core are set therein. In this case, the supply ribbon core and the take-up ribbon core are separately removed from the cassette body and separately set therein. Thus, a user must replace the supply ribbon core and the take-up ribbon core by using both hands. That is, as the ink ribbon must be replaced by using both hands, the work required for replacing the ink ribbon is not easy. When one of the supply ribbon core and the take-up ribbon core falls off the cassette body during the replacing of the ink ribbon, the ink ribbon wound to the supply ribbon core becomes loose. In this case, the ink ribbon may no longer be used in the printer. When the ink ribbon is set into a ribbon running path after the supply core and the take-up core are set at predetermined positions in the cassette body, the supply core and the take-up core may be removed from the setting positions.

SUMMARY OF THE PRESENT INVENTION

Accordingly, a general object of the present invention is to provide a novel and useful ink ribbon cassette in which the disadvantages of the aforementioned prior art are eliminated.

A more specific object of the present invention is to provide a method for setting an ink ribbon into a cassette body by which method the ink ribbon can be easily set into the cassette body.

The above objects of the present invention are achieved by a method for setting an ink ribbon wound to a first core and a second core into a cassette body having a bottom plate on which a setting hole is formed, the setting hole being divided into a first hole part for rotatably supporting the first core, a second hole part for rotatably supporting the second core, and a third hole part connecting the first and second hole parts which are at a predetermined distance from each other, the method comprising the steps of: (a) setting an assembly into the setting hole formed on the bottom plate of the cassette body, the assembly being formed of the first and second cores on which the ink ribbon is wound and a supporting member detachably supporting the first and second cores, a distance between the first and second cores supported by the supporting member corresponding to the distance between the first and second hole parts formed on the bottom plate of the cassette body; (b) detaching the supporting member from the first and second cores; and (c) drawing the supporting member from the cassette body through the setting hole, so that the first and second cores remain in the cassette body in a state where the first and second cores are respectively set into the first and second hole parts formed on the bottom plate of the cassette body.

According to the method of the present invention, the first and second cores to which the ink ribbon is wound are set in the cassette body using the supporting member supporting the first and second cores a predetermined distance from each other. Thus, the first and second cores can be easily set into the cassette body.

Another object of the present invention is to provide an ink ribbon cassette in which an ink ribbon can be easily replaced.

The above objects of the present invention are achieved by an ink ribbon cassette comprising: a cassette body having a bottom plate on which a setting hole is formed, the setting hole being divided into a first hole part, a second hole part, and a third hole part connecting the first and second hole parts which are at a predetermined distance from each other; a first core detachably set rotatably in the first hole part of the setting hole formed on the bottom plate of the cassette body; a second core detachably set rotatably in the second hole part of the setting hole; and an ink ribbon wound on the first and second cores, wherein an assembly formed of the first and second cores and a supporting member detachably supporting the first and second cores can be set into the setting hole formed on the bottom plate of the cassette body, and once the supporting member is detached from the first and second cores the supporting member can then be drawn from the cassette body through the setting hole.

According to the ink ribbon cassette of the present invention, the first and second cores on which the ink ribbon is wound can be replaced using the supporting member supporting the first and second cores at a predetermined distance from each other. Thus, the first and second cores can be easily replaced.

Additional objects, features and advantages of the present invention will become apparent from the following detailed description when read in conjunction with the accompanying drawings.

DESCRIPTION OF THE PREFERRED EMBODIMENTS

A description will now be given, with reference to FIGS. 1 through FIG. 5, of an embodiment of the present invention.

Figure 1:
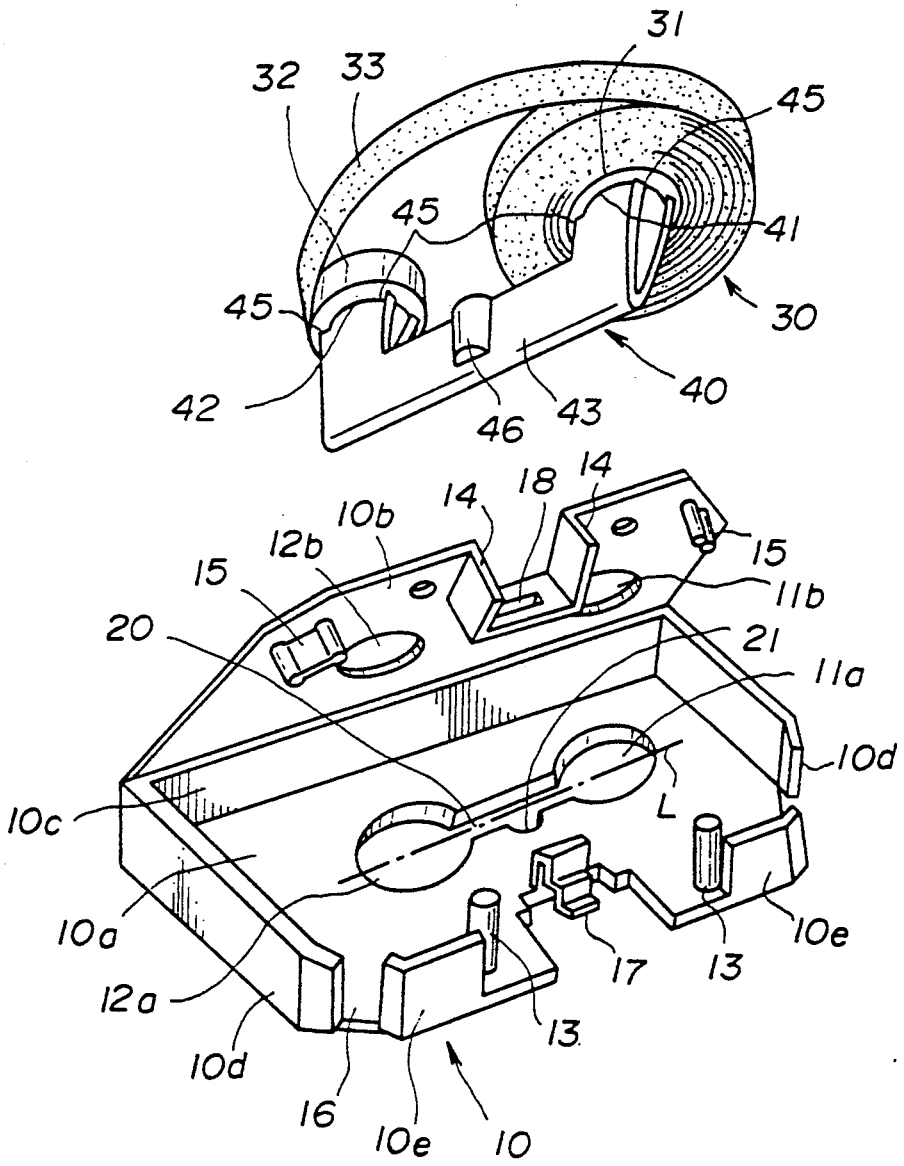
FIG. 1 is a perspective view illustrating an ink ribbon cassette according to an embodiment of the present invention.

An ink ribbon cassette according to the embodiment of the present invention is formed as shown in to FIG. 1. Referring to FIG. 1, the ink ribbon cassette has a cassette body 10 and an ink ribbon roll assembly 30. The ink ribbon roll assembly 30 can be mounted in the cassette body 10 and can be removed therefrom. That is, the ink ribbon roll assembly 30 mounted in the cassette body 10 can be replaced.

Figure 2:
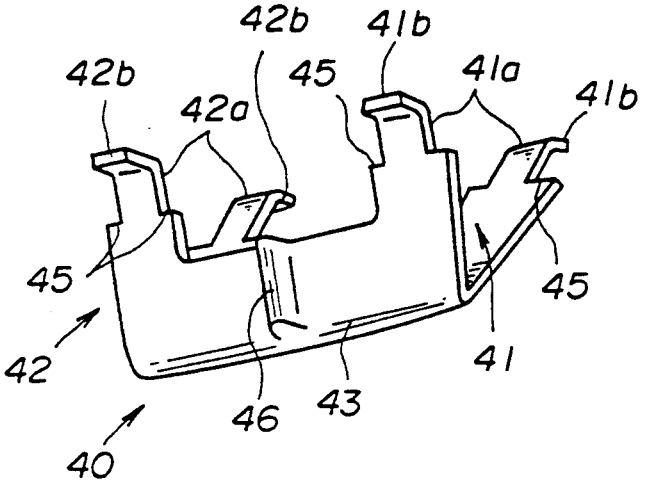
FIG. 2 is a perspective view illustrating a supporting member for a supply ribbon core and a take-up ribbon core.

The ink ribbon roll assembly 30 comprises a supply ribbon core 31, a take-up ribbon core 32 and an ink ribbon 33. The ink ribbon 33 is wound to the supply ribbon core 31 and an end of the ink ribbon 33 is fixed on the take-up core 32. The supply core 31 and the take-up core 32 are short. A supporting member 40 is engaged with the ink roll assembly 30. The supporting member 40 is made of resin having an elastic property, and is shaped as shown in FIG. 2. That is, the supporting member 40 is formed of a plate doubled up in a V-shape and has a pinching part 43 and supporting parts 41 and 42. The supporting parts 41 and 42 are formed at ends of the pinching part 43 so as to be parallel to each other. The pinching part 43 extends in a direction perpendicular to each of the supporting parts 41 and 42. The supporting parts 41 and 42 are respectively provided with core engaging parts 41*a* and 42*a*. The width of the plate corresponding to each of the core engaging parts 41*a* and 42*a* is less than the width of the plate corresponding to other portions of the supporting parts 41 and 42. Thus, stopper steps 45 are formed at the bases of the core engaging parts 41*a* and 42*a*. The width of the plate corresponding to each of the core engaging parts 41*a* and 42*a* is less than the inside diameter of the supply ribbon core 31 and less than that of the take-up ribbon core 32, and the width of the plate corresponding to the other positions of the supporting parts 41 and 42 is greater than the inside diameter of the supply ribbon core 31 and than that of the take-up ribbon core 32. Flanges 41*b* and 42*b* project, at the ends of the core engaging parts 41*a* and 42*a*, of the core engaging parts 41*a* and 42*a* to the outside. The pinching part 43 is provided with a projection 46 at the center thereof.

Figure 3:
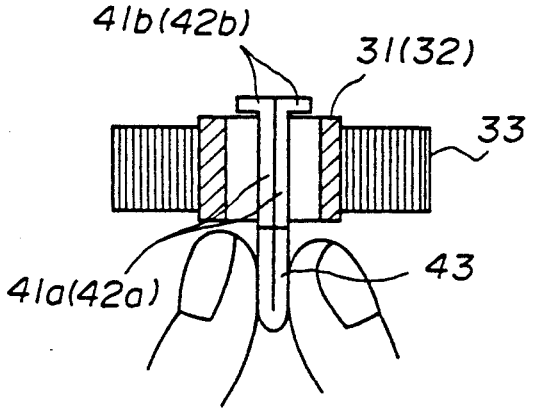
FIGS. 3 and 4 are cross sectional views illustrating operations of the supporting member.
Figure 4:
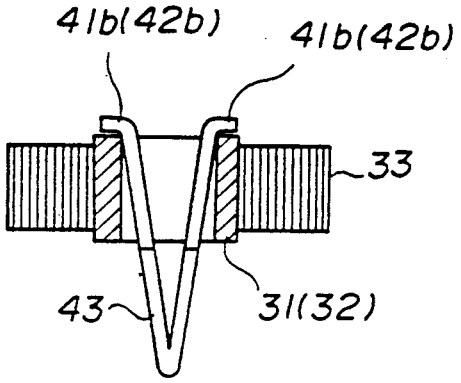

When the pinching part 43 of the supporting member 40 is pinched by fingers, the supporting member 40 is folded. In this folded state, the core engaging parts 41*a* and 42*a* are respectively inserted into the supply ribbon core 31 and into the take-up ribbon core 32 until the bottom surfaces of the supply ribbon core 31 and the take-up ribbon core 32 are brought into contact with the stopper steps 45 of the supporting parts 41 and 42, as shown in FIG. 3. In this state, the flanges 41*b* and 42*b* provided at the ends of the engaging parts 41*a* and 42*a* are respectively out of the supply ribbon core 31 and the take-up ribbon core 32. Then, when the fingers become disengaged from the pinching part 43 of the supporting member 40, the supporting member 40 expands due to the repulsion force of the supporting member 40 which has been folded, so as to become the V-shape. As a result, the flanges 41*b* and 42*b* are respectively engaged with rims of the supply ribbon core 31 and the take-up ribbon core 32, as shown in FIG. 4. In this state, the supply ribbon core 31 and the take-up ribbon core 32 are respectively sandwiched between the flanges 41*b* and 42*b* and the stopper steps 45. That is, the supporting member 40 is engaged with the ink ribbon roll assembly 30, so that the distance between the supply ribbon core 31 and the take-up ribbon core 32 is maintained at a predetermined distance due to the support from the supporting parts 41 and 42 of the supporting member 40.

The cassette body 10 has a bottom plate 10, a lid 10*b* and walls 10*c–e* provided on edges of the bottom plate 10*a* so as to surround the bottom plate 10*a*. The walls include a rear wall 10*c*, side walls 10*d* and a front wall 10*e*. An edge of the lid 10*b* is connected to the rear wall 10*c* so that the lid 10*b* can open and close. The cassette body 10 is made by a plastic mold forming process. First core receiving holes 11*a* and 12*a* are formed on the bottom plate 10*a*. The distance between the core-receiving holes 11*a* and 12*a* corresponds to the distance between the supporting parts 41*a* and 42*a* of the supporting member 40. Second core-receiving holes 11*b* and 12*b* are formed on the lid 10*b* so as to respectively face the first core-receiving holes 11*a* and 12*a* in a state where the lid 10*a* is closed. The supply ribbon core 31 and the take-up ribbon core 32 are respectively engaged with the first and second core-receiving holes 11*a* and 11*b* and 12*a* and 12*b* so as to be rotatable. A longitudinal hole 20 is formed on the bottom plate 10*a* so as to connect the first receiving holes 11*a* and 12*a*. The longitudinal hole 20 has a corresponding area sufficient for the pinching part 43 of the supporting member 40 to pass through the hole 20. A notch 21 is formed at the center of an edge of the longitudinal hole 20 so that the shape of the longitudinal hole 20 is asymmetrical with respect to a center line L thereof. The notch 21 can be engaged with the projection 46 formed on the pinching part 43 of the supporting member 40. Windows are formed on the front wall 10*e* at the center of the wall 10*e* and at both sides thereof. One of the windows formed at the sides of the front wall 10*e* is used as a ribbon end detecting window 16 through which a ribbon end-mark formed on the ink ribbon may be detected. Guide poles 13 project from the bottom plate 10*a* so as to provide one guide pole 13 across each of ends of the window at the center of the front wall 10*e*. A C-shaped guide plate 14 projects from the lid 10*b* so as to correspond to the window at the center of the front wall 10*e*. Guide plates 15 project from the lid 10*b* so as to provided one guide plate 15 across each of the windows at the sides of the front wall 10*e*. In a state where the ink ribbon roll assembly 30 is set in the ribbon cassette 10, the ink ribbon 33 is guided by the guide poles 13, the C-shaped guide plate 14 and the guide plates 15. That is, a ribbon running path is formed by the guide poles 13, the C-shaped guide plate and the guide plates 15, and the ink ribbon 33 moves from the supply ribbon core 31 to the take-up ribbon core 32 through the ink running path.

The front edge of the bottom plate 10*a* is provided with a click 17. A hole 18 is formed at the center of the C-shaped guide plate 14. In a state where the lid 10*b* is closed, the click 17 is engaged in the hole 18 so that the lid 10*b* is locked.

The ribbon roll assembly 30 is set in the cassette body 10 as follows.

Figure 5:
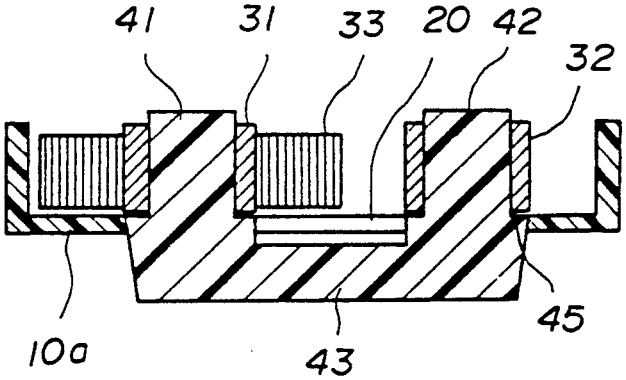
FIG. 5 is a cross sectional view illustrating a state where the supporting member rotatably supports the supply ribbon core and the take-up core.

The supporting member 40 has been engaged with the ribbon roll assembly 30. In this state, the supporting member 40 is inserted into the first core-receiving holes 11*a* and 12*a* and the longitudinal hole 20 which holes are formed on the bottom plate 10*a* of the cassette body 10. At this time, if the projection 46 formed on the pinching part 43 of the supporting member 40 faces the rear wall 10*c*, the supporting member 40 is not insertable into the holes 11*a*, 11*b* and 20. Only when the projection 46 is engaged with the notch 21 (the projection 46 faces the front wall 10*e*), the supporting member 40 can be inserted into the holes 11*a*, 12*a* and 20. Then, the supporting member 40 is out of the bottom plate 10*a*, as shown in FIG. 5. In this state, the ink ribbon 33 is made more slack so as to loosely extend along the ribbon running path and be guided by the guide poles 13. After this, the pinching part 43 protruding outside of the longitudinal hole 20 formed on the bottom plate 10*a* is strongly pinched by the fingers so that the supporting member 40 is folded as shown in FIG. 3. In this state, when the supporting member 40 is pulled, the supporting parts 41*a* and 42*a* of the supporting member 40 are detached from the supply ribbon core 31 and the take-up ribbon core, and the supporting member 40 is drawn from the cassette body 10 through the first core-receiving holes 11*a* and 12*a* and the longitudinal hole 20. As a result, the supply ribbon core 31 and the take-up ribbon core 32 are respectively engaged in the first core-receiving holes 11*a* and 12*a*. Then, the lid 10*b* is closed and the click 17 is engaged with the hole 18 so that the lid 10*b* is locked. Now, the ink ribbon assembly 30 is completely set in the cassette body 10.

According to the above embodiment, as the ribbon roll assembly 30 is engaged with the supporting member 40, the distance between the supply ribbon core 31 and the take-up ribbon core 32 is maintained constant during the setting of the ribbon roll assembly 30 into the cassette body 10. Thus, the ribbon roll assembly 30 can be easily set into the cassette 10 using only one hand. Further, if the projection 46 formed on the supporting member 40 is not engaged in the notch 21 formed in the longitudinal hole 20, it is not possible to set the ribbon roll assembly 30 into the cassette body 10. Thus, the ribbon roll assembly 30 is prevented from being set in an incorrect direction.

In addition, in a state where the supply ribbon core 31 and the take-up ribbon core 32 are rotatably mounted in the cassette body 10 by means of the supporting member 40, the work for setting the ink ribbon 33 into the running path is completed. Thus, the work can be performed easily and precisely.

The present invention is not limited to the aforementioned embodiments, and variations and modifications may be made without departing from the scope of the claimed invention.

What is claimed is:

1. A method for setting an ink ribbon wound on a first core and a second core into a cassette body having a bottom plate on which a setting hole is formed, said setting hole being divided into a first hole part for rotatably supporting said first core, a second hole part for rotatably supporting said second core, and a third hole part connecting said first and second hole parts which are a predetermined distance from each other, said method comprising the steps of:

(a) setting an assembly into said setting hole formed on said bottom plate of said cassette body, said assembly being formed of said first and second cores on which said ink ribbon is wound and a supporting member detachably supporting said first and second cores, a distance between said first and second cores supported by said supporting member corresponding to the distance between said first and second hole parts formed on said bottom plate of said cassette body;

(b) detaching said supporting member from said first and second cores; and (c) drawing said supporting member from said cassette body through said setting hole, so that said first and second cores remain in said cassette body in a state where said first and second cores are respectively set into said first and second hole parts formed on said bottom plate of said cassette body.

2. A method as claimed in claim 1, further comprising the step of:

(a') forming said assembly so that said supporting member detachably supports said first and second cores, said step (a') being performed before said step (a).

3. An ink ribbon cassette comprising:

a cassette body having a bottom plate on which a setting hole is formed, said setting hole being divided into a first hole part, a second hole part and a third hole part connecting said first and second hole parts which are a predetermined distance from each other;

a first core detachably and rotatably set in said first hole part of said setting hole formed on said bottom plate of said cassette body;

a second core detachably and rotatably set in said second hole part of said setting hole; and an ink ribbon wound on said first and second cores, wherein an assembly formed of said first and second cores and a supporting member detachably supporting said first and second cores can be set into said setting hole formed on said bottom plate of said cassette body, and said supporting member is detached from said first and second cores and can be drawn from said cassette body through said setting hole.

4. An ink ribbon cassette as claimed in claim 3, wherein a shape of said third hole part of said setting hole is asymmetrical with respect to a line parallel to a direction in which said first and second cores are arranged in said cassette body.

5. An ink ribbon cassette as claimed in claim 4, wherein a notch is formed on an edge of said third hole part of said setting hole.

6. An assembly comprising:

a first core;

a second core;

a ink ribbon wound on said first and second cores; and a supporting member for detachably supporting said first and second cores which are a predetermined distance from each other, wherein said assembly can be set into a setting hole formed on a bottom plate of an ink ribbon cassette, said setting hole being divided into a first hole part for rotatably supporting said first core, a second hole part for rotatably supporting said second core, and a third hole part connecting said first and second hole parts at a distance corresponding to the distance between said first and second cores supported by said supporting member, said supporting member being detachable from said first and second cores and capable of being drawn from said ink ribbon cassette through said setting hole.

7. An assembly as claimed in claim 6, wherein said supporting member is made of a plate formed in a V-shape, said supporting member having a pinching part and supporting parts formed at ends of said pinching part, and wherein said supporting parts are inserted into and detached from said first and second cores in a state where said supporting member is being folded by means of pinching said pinching part, and said supporting parts are engaged with said first and second cores in a state where said supporting member has expanded so as to become the V-shape due to a repulsion force of said supporting member.

8. An assembly as claimed in claim 6, wherein a shape of said supporting member is asymmetrical to a plane including a line parallel to a direction in which said first and second cores are to be arranged, said plane being parallel to a direction in which said supporting member supports said first and second cores, and wherein said assembly can be set into said setting hole having a shape corresponding to said shape of said supporting member.

9. An assembly as claimed in claim 8, wherein said supporting member has a projection formed on a surface thereof.

10. A supporting member for supporting a first core and a second core to which an ink ribbon is wound; said supporting member comprising:

a first part for detachably supporting said first core;

a second part for detachably supporting said second core; and a third part connecting said first part and second part which are a predetermined distance from each other, wherein an assembly formed of said supporting member and said first and second cores can be set into a setting hole formed on a bottom plate of an ink ribbon cassette, said setting hole being divided into a first hole part for rotatably supporting said first core, a second hole part for rotatably supporting said second core, and a third hole part connecting said first and second hole parts at a distance corresponding to the distance between said first and second parts of said supporting member, said supporting member being detachable from said first and second cores and capable of being drawn from said ink ribbon cassette through said setting hole.

11. A supporting member as claimed in claim 10, wherein said supporting member is made of a plate formed in a V-shape, and wherein said first and second parts may be inserted into and detached from said first and second cores in a state where said supporting member is folded by pinching said third part, and said supporting parts engage with said first and second cores in a state where said supporting member is expanded so as to become the V-shape due to the repulsion force of said supporting member.

12. A supporting member as claimed in claim 10, wherein a shape of said supporting member is asymmetrical to a plane including a line parallel to a direction in which said first and second cores are to be arranged, said plane being parallel to a direction in which said supporting member supports said first and second cores, and wherein said assembly can be set into said setting hole having a shape corresponding to said shape of said supporting member.

13. A supporting member as claimed in claim 12, wherein said third part has a projection formed on a surface thereof.

* * * * *